US008850983B2

(12) United States Patent
Leib et al.

(10) Patent No.: US 8,850,983 B2
(45) Date of Patent: Oct. 7, 2014

(54) PRODUCTION UNIT HAVING AN INDIVIDUAL DRIVE AND PRINTING PRESS HAVING AT LEAST ONE PRODUCTION UNIT

(75) Inventors: Rudolf Leib, Wiesloch (DE); Josef Winkelmann, Reken (DE); Ralf Würdinger, Schwetzingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 27 days.

(21) Appl. No.: 13/331,637

(22) Filed: Dec. 20, 2011

(65) Prior Publication Data

US 2012/0152134 A1 Jun. 21, 2012

(30) Foreign Application Priority Data

Dec. 20, 2010 (DE) ..... 10 2010 055 256

(51) Int. Cl.

| | |
|---|---|
| ***B41L 3/02*** | (2006.01) |
| ***B41F 5/02*** | (2006.01) |
| ***B41F 19/00*** | (2006.01) |
| ***B41F 23/08*** | (2006.01) |

(52) U.S. Cl.

CPC ..... *B41F 23/08* (2013.01); *B41F 19/00* (2013.01); *B41P 2213/734* (2013.01)

USPC ..... 101/486; 101/216

(58) Field of Classification Search

CPC ..... B41F 19/00; B41F 33/009

USPC ..... 101/23, 484, 485, 486, 216

See application file for complete search history.

(56) References Cited

U.S. PATENT DOCUMENTS

| | | | | |
|---|---|---|---|---|
| 6,095,043 | A * | 8/2000 | Hartmann et al. | 101/183 |
| 7,478,593 | B2 * | 1/2009 | Hefftler et al. | 101/484 |
| 7,709,986 | B2 | 5/2010 | Schild et al. | |
| 8,042,466 | B2 | 10/2011 | Bechtler et al. | |
| 2007/0227379 | A1 * | 10/2007 | Sato et al. | 101/389.1 |

FOREIGN PATENT DOCUMENTS

| | | | |
|---|---|---|---|
| DE | 102 46 072 | A1 | 5/2003 |
| DE | 10 2004 050 725 | A1 | 4/2006 |
| DE | 10 2009 020 753 | A1 | 11/2010 |
| EP | 1 935 644 | A1 | 6/2008 |
| EP | 2 067 621 | A1 | 6/2009 |
| WO | 2010/124808 | A1 | 11/2010 |

OTHER PUBLICATIONS

German Patent and Trademark Office Search Report, Dated July 29, 2011.

* cited by examiner

*Primary Examiner* — Daniel J Colilla
*Assistant Examiner* — John M Royston
(74) *Attorney, Agent, or Firm* — Laurence A. Greenberg; Werner H. Stemer; Ralph E. Locher

(57) ABSTRACT

A production unit for a printing material processing machine includes a drive, a computer, a cylinder and an associated impression cylinder having a circumference different from that of the cylinder. Provision is made to detect an increase in drive torque on the cylinder and to calculate therefrom a differential angle of rotation varying at least over one revolution between the cylinder and the impression cylinder in the computer, to be used to actuate the drive of the cylinder. A printing press having at least one production unit is also provided.

10 Claims, 3 Drawing Sheets

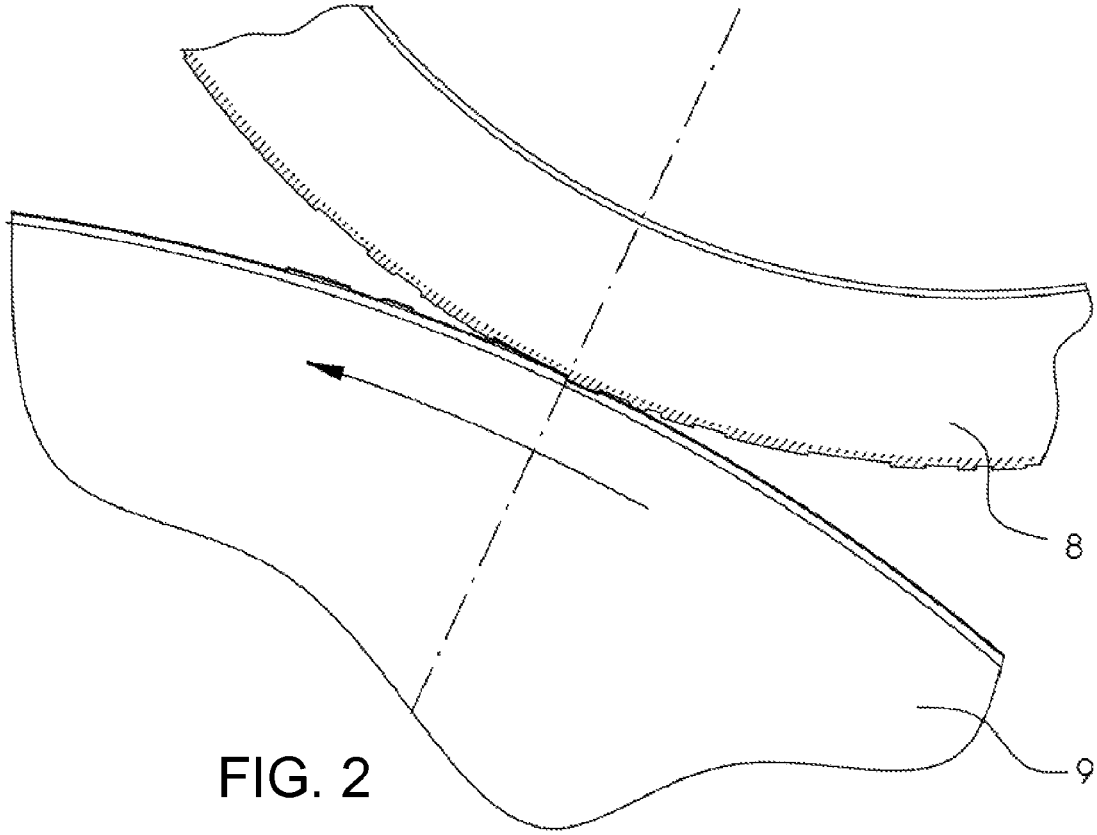
FIG. 2
FIG. 3
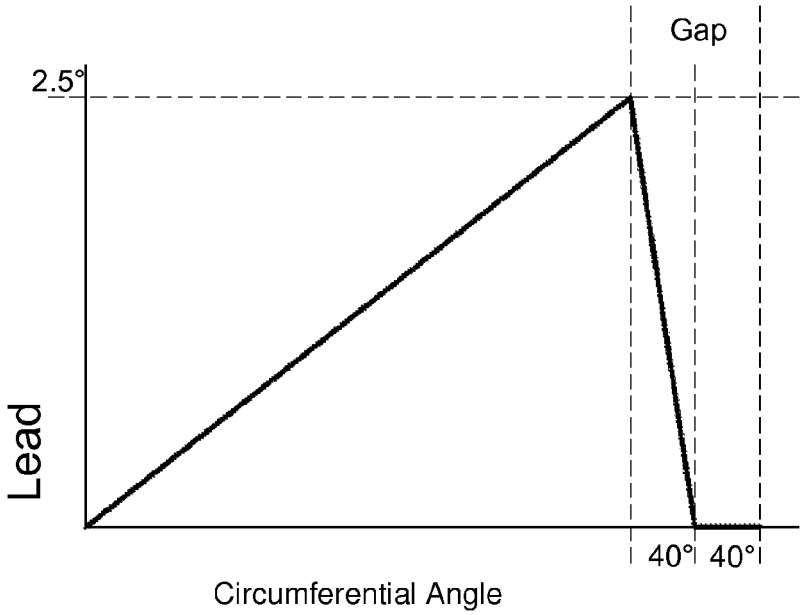

PRODUCTION UNIT HAVING AN INDIVIDUAL DRIVE AND PRINTING PRESS HAVING AT LEAST ONE PRODUCTION UNIT

CROSS-REFERENCE TO RELATED APPLICATION

This application claims the priority, under 35 U.S.C. §119, of German Patent Application DE 10 2010 055 256.9, filed Dec. 20, 2010; the prior application is herewith incorporated by reference in its entirety.

BACKGROUND OF THE INVENTION

Field of the Invention

The present invention relates to a production unit for a printing material processing machine including a drive, a computer, a cylinder as well as an associated impression cylinder having a circumference which is different than that of the cylinder. The invention also relates to a printing press having at least one production unit.

In the context of the present invention, a production unit is understood to refer to a printing unit, a varnishing unit, or a stamping/embossing unit of a printing press, in particular a sheet-fed offset printing press. A sheet-fed printing press usually includes a number of printing units each of which prints a different color. Alongside the printing units, it is possible to provide other production units such as an embossing unit or a stamping unit for stamping cold-foils or carrying out other stamping or embossing operations or a varnishing unit. In addition to the production modules, drier modules may be provided at the exit of the varnishing unit to dry the applied varnish. In general, all production units in a sheet-fed printing press are driven by a main drive motor. Some configurations are known in which at least some of the production units have a drive motor of their own for printing units and cylinders. Such a configuration is disclosed, for example, in German Published Patent Application DE 102 46 072 A1, which describes a rotary printing method for multicolor printing. In accordance with the disclosed method, it is possible to carry out printing length corrections during a printing cycle of a cylinder revolution. For that purpose, the plate cylinder and the impression cylinder are driven separately to achieve a speed difference to adjust the printing length correction as printing ink is being transferred to a printing material in each revolution of the plate cylinder in cooperation with at least one impression cylinder and usually a blanket cylinder located between the plate cylinder and the impression cylinder. In the printing units, for instance, the plate cylinders have separate electric drive motors. No mechanical coupling exists between the plate cylinder and the impression cylinder. The blanket cylinder and the plate cylinder may be mechanically coupled. In each revolution of the plate cylinder, starting at zero and increasing continuously, the differential angle between the plate cylinder and the associated impression cylinder is set to a maximum value and preferably reset upon the passage of the gap. Thus, for every revolution of the plate cylinder, a correction of the printing length is carried out. That is one way to compensate for printing defects caused by printing length errors by controlling the individual drives of the plate cylinders and increasing or reducing the printing length.

In stamping/embossing units or varnishing units and in combinations of those units which are suitable for embossing/stamping or varnishing, sleeves instead of plates are becoming increasingly common as cylinder covers for embossing/stamping and varnishing. In that context, errors may occur in the creation of the printing formes or in the selection of the thickness of the cover, thus causing the stamping/embossing or varnishing length to no longer correspond to the offset printing length pre-printed in the printing units. That lack of correspondence is due to the fact that the errors cause the forme cylinder carrying the stamping/embossing forme or varnishing forme to have a different diameter than the adjacent impression cylinder. Consequently, slip would occur between the forme cylinder and the impression cylinder if the rotational speed of the cylinders was the same, or the impression cylinder and the forme cylinder would rotate at different speeds if they were not mechanically coupled.

SUMMARY OF THE INVENTION

It is accordingly an object of the invention to provide a production unit for embossing and/or varnishing and a printing press having at least one production unit, which overcome the hereinafore-mentioned disadvantages of the heretofore-known units and printing presses of this general type and in which different circumferences of a forme cylinder and of an associated impression cylinder can be compensated for by using an individual drive motor.

With the foregoing and other objects in view there is provided, in accordance with the invention, a production unit for a sheet processing machine, comprising a cylinder carrying a varnishing or stamping/embossing forme and cooperating with an associated impression cylinder to varnish, stamp or emboss printing material. In addition, the production unit of the invention includes a drive for modifying the relative speed of the cylinder and the associated impression cylinder. The impression cylinder and the cylinder have different circumferences. This circumferential difference is compensated for by suitably actuating the drive. For this purpose, a sensor is provided to detect an increase of the drive torque at the cylinder resulting from the different circumferences of the cylinder and the impression cylinder. From this, a computer calculates a differential angle of rotation between the cylinder and the impression cylinder varying over at least one revolution. This differential angle of rotation is used to actuate the drive of the production unit to compensate for the diameter difference between the cylinders. This is also a way to control the printing length in the varnishing process. For actuation purposes, the rotational speed of the cylinder is controlled in accordance with the diameter ratio and analogously with the current printing speed of the machine. The drive used in the production unit may be a separate electric drive or a variable gearing mechanism for varying the speed of the cylinder in the production unit relative to the associated impression cylinder and further cylinders in the other printing units in the printing press, which are in this case driven by a main drive motor of the printing press. However, the preferred embodiment includes a separate electric drive motor in the production unit, which is particularly easy to control simply by suitably setting the speed of the separate electric drive motor through the computer of the power electronics.

Due to the actuation at different speed over at least one revolution, the necessity arises to reset the differential angle of rotation to zero for each new revolution. This is preferably done when the cylinder rolls over the gap of the impression cylinder because at this point contact between the impression cylinder and the associated cylinder is at a minimum. The actuation of the separate drive motor as a function of the driving torque and the passage of the gap while the cylinders rotate is preferably carried out in an angle-controlled way. This causes the individual drive to rotate the cylinder carrying the stamping/embossing or varnishing forme in the region of the printing length without slip relative to the printing material, i.e. in a manner corresponding to the pre-printed image. The resultant lead or lag of the cylinder relative to the actual correct rotational angle will then be corrected during the passage of the gap in such a way as to ensure that for the next revolution, the beginning of the print of the cylinder carrying the varnishing or embossing/stamping forme precisely coincides with the printing material on the impression cylinder.

In order to match positions and rotational speeds between the cylinder and the impression cylinder, the impression cylinder includes an angle transmitter, the signals of which are used to actuate the separate drive motor of the cylinder. The cylinder also includes a device for detecting the angle of rotation. Both signals are fed to the control device of the separate drive motor for the cylinder in order for the control device to be able to match the rotational speed and the angle of rotation of the cylinder with the rotational speed and the angle of rotation of the impression cylinder. The device for detecting the angle of the cylinder may also be a rotary encoder or the encoder that is present in the separate drive motor in any case.

The production unit may be a stamping/embossing unit in which the cylinder carries a sleeve-shaped stamping/embossing forme. The production unit may likewise be a varnishing unit that receives a varnishing forme especially in the shape of a sleeve that is pulled onto the cylinder.

In accordance with a particularly advantageous embodiment, however, the production unit may be a combination unit for stamping/embossing and varnishing and may include a cylinder that may receive sleeves that are varnishing formes or stamping/embossing formes. In combination units of this type, being able to compensate for varnishing and stamping/embossing sleeves of varying thickness by actuating the individually driven cylinder is of particular importance. In this context, slip compensation is important during stamping/embossing operations. Printing length compensation, however, is not possible in this mode of operation since the stamping/embossing pressure between cylinder and impression cylinder is very high, thus causing a high moment of friction between the sleeve on the cylinder and the printing material on the impression cylinder. In the varnishing mode, pressure between the cylinder and the impression cylinder is lower, thus enabling printing length compensation between the cylinder and the impression cylinder in the varnishing mode of operation. An additional aspect is that the varnish that is present on the printing material has a positive effect on the slide friction between the cylinder and the impression cylinder.

The types of motors which are particularly suited as separate drive motors are highly dynamic electric motors that are capable of quickly and accurately implementing the required rotational speed variations.

With the objects of the invention in view, there is also provided a printing press, comprising at least one production unit according to the invention.

Other features which are considered as characteristic for the invention are set forth in the appended claims.

Although the invention is illustrated and described herein as embodied in a production unit having an individual drive and a printing press having at least one production unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 2 is an enlarged, fragmentary, side-elevational view of a cylinder, which carries a stamping/embossing forme, rolling off on an adjacent impression cylinder;

FIG. 3 is a diagram illustrating a varying differential angle between the cylinder and the impression cylinder over one revolution;

DETAILED DESCRIPTION OF THE INVENTION

Figure 1:
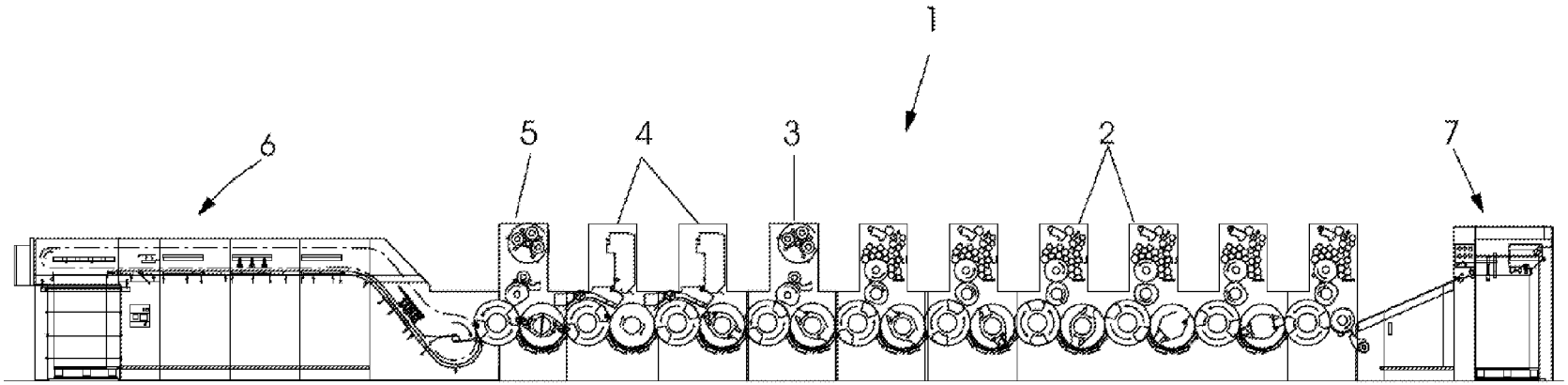
FIG. 1 is a diagrammatic, longitudinal-sectional view of a sheet-fed printing press having a number of printing units, a varnishing unit, two driers, and a stamping/embossing unit.
Figure 5:
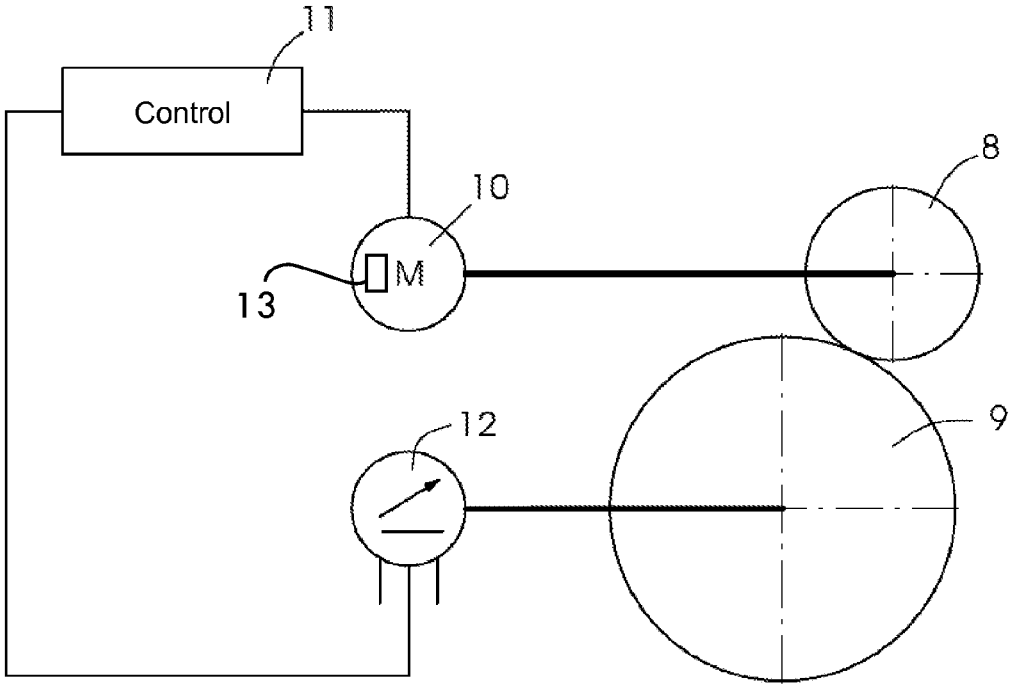
FIG. 5 is a schematic and block diagram illustrating a principal configuration of a control of a separate drive motor for a production unit of the invention.

Referring now to the figures of the drawings in detail and first, particularly, to FIG. 1 thereof, there is seen an exemplary embodiment of a sheet-fed printing press 1 which includes six printing units 2, a varnishing unit 3 disposed downstream of the printing units 2, two driers 4 disposed downstream of the varnishing unit 3 and a stamping/embossing unit 5. In the context of the present application, the printing units 2, the stamping/embossing unit 5 and the varnishing unit 3 are referred to as production units. In addition, the printing press 1 includes a delivery 6 where the finished printing material is deposited and a feeder 7 at the entrance of the printing press 1 for feeding new printing material to the printing units 2. In the printing press 1, all of the printing units 2, the varnishing unit 3 and the stamping/embossing unit 5 are mechanically coupled by a gear train. The gear train is driven by a main drive motor of the printing press 1. It is likewise possible to provide an individual drive for every printing unit 2, stamping/embossing unit 5 or varnishing unit 3. In order to implement the present invention, however, it is sufficient to provide an individual drive motor 10 for a cylinder 8 in the varnishing unit 3 and in the stamping/embossing unit 5, as seen in FIG. 5. These units are substantially formed of the cylinder 8 for receiving varnishing formes or stamping/embossing formes and an associated impression cylinder 9. The separate drive motor 10 ensures that the cylinder 8 in the stamping/embossing unit 5 and in the varnishing unit 3 may be driven while mechanically uncoupled from the printing units 2 and from the impression cylinders 9 in the varnishing unit 3 and in the stamping/embossing unit 5. Thus, the stamping/embossing cylinder 8 in the stamping/embossing unit 5 and the varnishing cylinder in the varnishing unit 3 can be rotated relative to the associated impression cylinders 9 through the use of the associated electric drive motor 10.

FIG. 2 illustrates a point of contact between the stamping/embossing forme on the cylinder 8 and the printing material on the impression cylinder 9 in the stamping/embossing unit 5. In the varnishing unit 3, the situation is similar, with the only difference being that the cylinder 8 does not carry a stamping/embossing forme but instead a varnishing forme made of a soft material. In the stamping/embossing unit 5, the pressure between the cylinder 8 and the impression cylinder 9 is high since it is required for stamping/embossing. For this reason, no slip may occur between the cylinder 8 and the impression cylinder 9. When the cylinder 8 and the impression cylinder 9 have a different circumference, they cannot rotate at the same rotational speed. Therefore, in order to be able to start correctly for every sheet at every revolution, the angular offset between the cylinder 8 and the impression cylinder 9 caused by the different diameters must be compensated for.

This correction of the angle of rotation, also referred to as a differential angle, is shown in FIG. 3. As can be seen, at the beginning of a new revolution and at the beginning of a new image, the differential angle starts at zero and increases to 2.5 degrees up until a gap of the impression cylinder 9. As soon as the gap of the impression cylinder 9 is reached, the differential angle is re-set to zero by a corresponding modification of the rotational speed of the stamping/embossing cylinder 8. This modification is achieved by suitably actuating the drive motor 10 and the cylinder 8.

Figure 4:
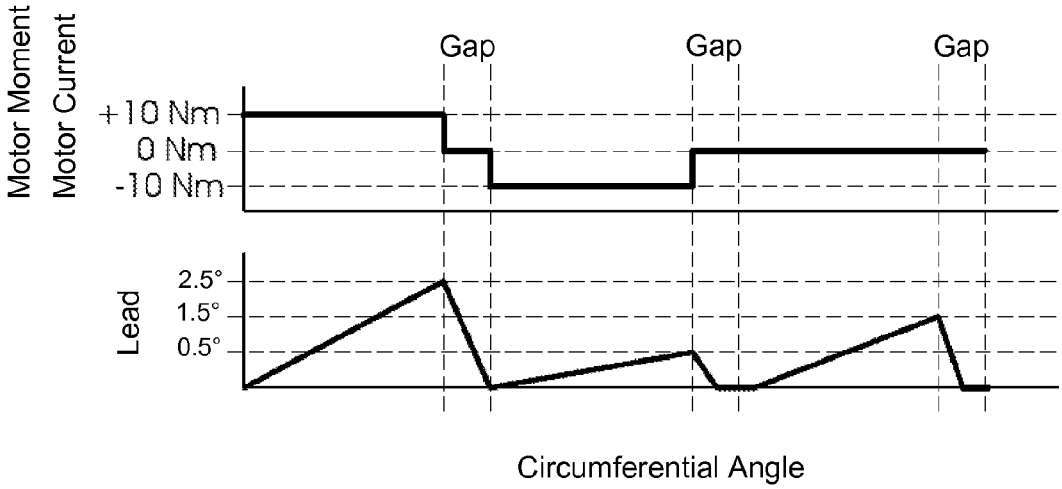
FIG. 4 is a diagram illustrating a motor torque plotted over a differential angle over a number of revolutions.

FIG. 4 illustrates a closed-loop control operation in which an optimum lead angle of 1.5 degrees is set by the control unit 11 in the power electronics of the drive motor 10 of the cylinder 8. The closed-loop control is shown to be based on the detection of the motor torque or motor current. The first step is to detect that an increased torque of +10 Nm occurs. The ideal lead angle of 1.5 degrees results when there is no slip, i.e. when the motor torque is 0 Nm. For this purpose, a counteracting motor torque of −10 Nm is applied to the drive motor 10 of the cylinder 8 to attain the desired lead angle of 1.5 degrees in the third revolution at 0 Nm. This automatic adjustment by a control 11 of the drive motor 10 of the cylinder 8 is based on the detection of the respective motor torque and angle of rotation. In a closed-loop control operation based on the motor torque, the drive motor 10 is actuated on the basis of the measurement of the motor torque, which is then either increased or reduced depending on whether a lead angle or a lag angle is desired or required. If the differential angle is ideal, the motor 10 runs at the lowest torque. Consequently, the lead or lag angle does not have to be set by the operator. Instead, it can be automatically set by the control or power electronics 11 of the drive motor 10 of the cylinder 8.

FIG. 5 illustrates the basic structure of the control loop for actuating the drive motor 10 for the stamping/embossing cylinder 8. In this context, it is sufficient if the varnishing unit 3 and the stamping/embossing unit 5 include a control loop 11 in which the drive motor 10 includes detecting means such as a sensor 13 for sensing the motor torque and in which this torque is controlled to be as low as possible. Alternatively, it is possible to detect the differential angle using a motor encoder of the motor 10 and an angular transmitter 12 on the impression cylinder 9, for instance when an additional lead or lag is desired such as in a varnishing operation to achieve printing length correction. In this case the operator may set an additional desired correcting angle for printing length correction in the control of the printing press 1. This correcting angle is then transmitted to the power electronics 11 of the drive motor 10 and is set on the basis of the detected angle of the impression cylinder 9 and the cylinder 8.

The invention claimed is:

1. A production unit for a sheet processing machine, the production unit comprising:

a varnishing, embossing, or stamping cylinder and an impression cylinder associated with each other and having different circumferences;

a drive for said varnishing, embossing, or stamping cylinder;

means for detecting an increased drive torque on said varnishing, embossing, or stamping cylinder; and a computer connected to said drive and to said detecting means;

said computer calculating a differential angle of rotation varying over at least one revolution between said varnishing, embossing, or stamping cylinder and said impression cylinder from said increased drive torque; and said computer using said differential angle of rotation to actuate said drive.

2. The production unit according to claim 1, wherein said drive is a separate drive motor.

3. The production unit according to claim 1, wherein said impression cylinder has a gap.

4. The production unit according to claim 3, wherein said drive is controlled as a function of said drive torque over one revolution during rotation of said cylinders and in an angle-controlled way during the passage of said gap.

5. The production unit according to claim 1, wherein said impression cylinder has an angle transmitter.

6. The production unit according to claim 1, wherein said varnishing, embossing, or stamping cylinder includes an angle detecting device.

7. The production unit according to claim 1, wherein the production unit is an embossing unit and said varnishing, embossing, or stamping cylinder is an embossing cylinder that has an embossing forme in the shape of a sleeve.

8. The production unit according to claim 1, wherein the production unit is a varnishing unit for receiving a varnishing forme in the shape of a sleeve being pulled onto said varnishing, embossing, or stamping cylinder.

9. The production unit according to claim 1, wherein the production unit is a combination unit for embossing and varnishing and said varnishing, embossing, or stamping cylinder receives sleeves in the form of a varnishing forme or an embossing forme being pulled onto said varnishing, embossing, or stamping cylinder.

10. A printing press, comprising:

at least one production unit according to claim 1.

* * * * *